US006481973B1

(12) United States Patent
Struthers

(10) Patent No.: US 6,481,973 B1
(45) Date of Patent: Nov. 19, 2002

(54) METHOD OF OPERATING VARIABLE-SPEED SUBMERSIBLE PUMP UNIT

(75) Inventor: Kevin D. Struthers, Coatesville, PA (US)

(73) Assignee: Little Giant Pump Company, Oklahoma City, OK (US)

( * ) Notice: Subject to any disclaimer, the term of this patent is extended or adjusted under 35 U.S.C. 154(b) by 0 days.

(21) Appl. No.: 09/585,042

(22) Filed: Jun. 1, 2000

Related U.S. Application Data

(63) Continuation-in-part of application No. 09/427,976, filed on Oct. 27, 1999, now abandoned.

(51) Int. Cl.[7] ..... F04B 49/06
(52) U.S. Cl. ..... 417/36; 417/44.11; 417/43
(58) Field of Search ..... 417/1, 44.1, 45, 417/44.11, 36, 43

(56) References Cited

U.S. PATENT DOCUMENTS

| | | | | |
|---|---|---|---|---|
| 3,461,803 | A | 8/1969 | Stothoff, III et al. | |
| RE28,104 | E | 8/1974 | Grace | |
| 3,904,131 | A | 9/1975 | Farrell, Jr. et al. | |
| 3,941,507 | A | 3/1976 | Niedermeyer | |
| 3,999,890 | A | 12/1976 | Niedermeyer | |
| 4,040,773 | A | 8/1977 | Tuzson | |
| 4,339,231 | A | 7/1982 | Conery et al. | |
| 4,867,871 | A | 9/1989 | Bowne | |
| 5,447,078 | A | 9/1995 | Robinson et al. | |
| 5,553,794 | A | 9/1996 | Oliver et al. | |
| 5,659,214 | A | 8/1997 | Guardiani et al. | |
| 5,883,489 | A | 3/1999 | Konrad | |
| 5,960,883 | A | 10/1999 | Tubel et al. | |
| 5,975,204 | A | 11/1999 | Tubel et al. | |
| 6,046,685 | A | 4/2000 | Tubel | |
| 6,244,825 | B1 * | 6/2001 | Sasaki et al. | 417/44.11 |
| 6,254,353 | B1 * | 7/2001 | Polo et al. | 417/44.11 |

* cited by examiner

*Primary Examiner*—Michael Koczo
(74) *Attorney, Agent, or Firm*—Drinker Biddle & Reath LLP

(57) ABSTRACT

A variable-speed submersible pump has a centrifugal pump, with a grinder for entrained solids at the intake, driven by a variable-speed 3-phase AC motor. A microcontroller controls the pump output on the basis of sensor data and/or inputs from an external controller, and also monitors the operation of the pump unit and emits alarms and statistical reports as appropriate. If the pump is clogged, the controller attempts to free it, firstly by reducing the pump speed and increasing the torque, secondly by jogging the pump backwards, and thirdly by running the pump briefly at maximum speed. Before pumping starts, and at intervals when the tank in which the pump is submerged is not full enough to be worth emptying, the pump is run backwards. That serves to agitate the tank, re-suspend any solids content that may tend to settle out in the tank, and thus improve pumping of the solids with the liquid. When the pump is pumping normally, it starts at a preset speed, and the pump speed may be increased in steps until a desired rate of pumping is achieved or until the maximum speed of the pump is reached.

54 Claims, 6 Drawing Sheets

METHOD OF OPERATING VARIABLE-SPEED SUBMERSIBLE PUMP UNIT

CROSS-REFERENCE TO RELATED APPLICATION

This application is a continuation-in-part of U.S. patent application Ser. No. 09/427,976 filed Oct. 27, 1999, now abandoned, the entire contents of which are incorporated herein by reference.

FIELD OF THE INVENTION

The invention relates to a method of operating a variable-speed submersible pump. More particularly, the invention relates to operating such a pump with an electronic speed control unit, which may be mounted immediately adjacent to the pump motor, inside the submersible pump unit.

BACKGROUND OF THE INVENTION

Submersible electric pumps have been known for many years. One common form of such pump consists of an electric motor attached to a centrifugal pump, the whole assembly being arranged to be lowered to the bottom of a well or borehole and connected to the surface by a cable for the supply of electric power and a hosepipe for the delivery of water. Such pumps are typically controlled by switching on and off the power supply, either automatically or manually, in response to demand for water at the surface.

Pumps for emptying drainage sumps and the like are also known, which are controlled by level switches. Such pumps typically start automatically when a level switch detects that the sump is full, and stop automatically when another level switch indicates that the sump is empty.

With both of those types of pump, there is typically no attempt to regulate the speed or output of the pump: it is simply either running or stopped. That means that the motor and pump are seldom running at their most efficient states, and that extremely conservative cut-off limits have to be set to prevent overloading or overheating of the motor or pump, requiring unduly large motors and pumps.

Frequency-controlled variable speed motors are known. However, when using such motors in submersible applications, it is usual to mount the controller in a dry situation, which necessitates a long power lead carrying the variable-frequency supply from the controller to the motor. That can result in serious electromagnetic interference (EMI) problems.

There is therefore a need for a submersible electric pump the speed of which can be optimized accurately to the exact operating conditions of the particular site at the particular time, which does not cause EMI problems, and which is economical, compact, and easy to install.

SUMMARY OF THE INVENTION

According to one aspect of the present invention, there is provided a method of operating a variable-speed pump driven by a motor capable of developing high torque at low speeds. The method comprises attempting to run the pump at a selected speed. It is determined, by assessing the torque being generated by the motor, whether the pump is clogged. When the torque being developed by the motor exceeds a maximum for the selected speed, the speed of the pump is reduced and the maximum acceptable torque for the motor is thereby increased. The torque is then permitted to rise unless and until it exceeds a maximum for the newly selected speed. The steps of reducing the speed and permitting the torque to rise are repeated, but if at any point it is determined that the pump is no longer clogged, normal pumping is resumed.

If the selected speed is reduced to a minimum speed and it is determined that the pump is still clogged, the pump may be run backwards, and the steps of running the pump forwards to try to clear the clog may be repeated. The pump may be run backwards a second time, forwards a third time, and backwards a third time.

The pump may be run forwards at maximum speed for a predetermined period of time, in a further attempt to clear the clog.

In another aspect of the invention, there is provided a method of operating a pump for emptying a tank that may contain both liquid and solids. The method comprises determining whether the tank is sufficiently full for emptying to be appropriate. If emptying is appropriate, the pump is run backwards to agitate and aerate the tank. After agitating and aerating the tank, the pump is run forwards to remove contents from the tank. If emptying is not appropriate, whenever a predetermined period has elapsed since the pump was last run, the pump is run backwards to agitate the tank.

The tank may be determined to be sufficiently full if the level of liquid in the tank is higher than a certain level.

The pump may be stopped when it is determined that the tank is empty. It may be determined that the tank is empty when the torque consumed by the pump decreases suddenly.

When emptying is not appropriate, the pump may be run backwards at a minimum operating speed of the pump. When the pump comprises an electric motor, the temperature of the motor may be monitored, and the pump may be stopped if its temperature is too high. The motor may then be restarted after a predetermined time, or when its temperature falls to a predetermined value.

An alarm may be emitted if the level of liquid in the tank exceeds an alarm level higher than the level at which emptying of the tank is appropriate.

According to another aspect of the invention, there is provided a method of operating a variable-speed pump, comprising running the pump at a selected speed. The pumping rate and pump speed are monitored, and the speed is incremented until either the pump is pumping fluid at a predetermined rate, or the pump is operating at a maximum speed.

BRIEF DESCRIPTION OF THE DRAWINGS

For the purpose of illustrating the invention, the drawings show a form of the invention which is presently preferred. However, it should be noted that the invention is not limited to the precise arrangements and instrumentalities shown in the drawings.

DETAILED DESCRIPTION OF THE INVENTION

Figure 1:
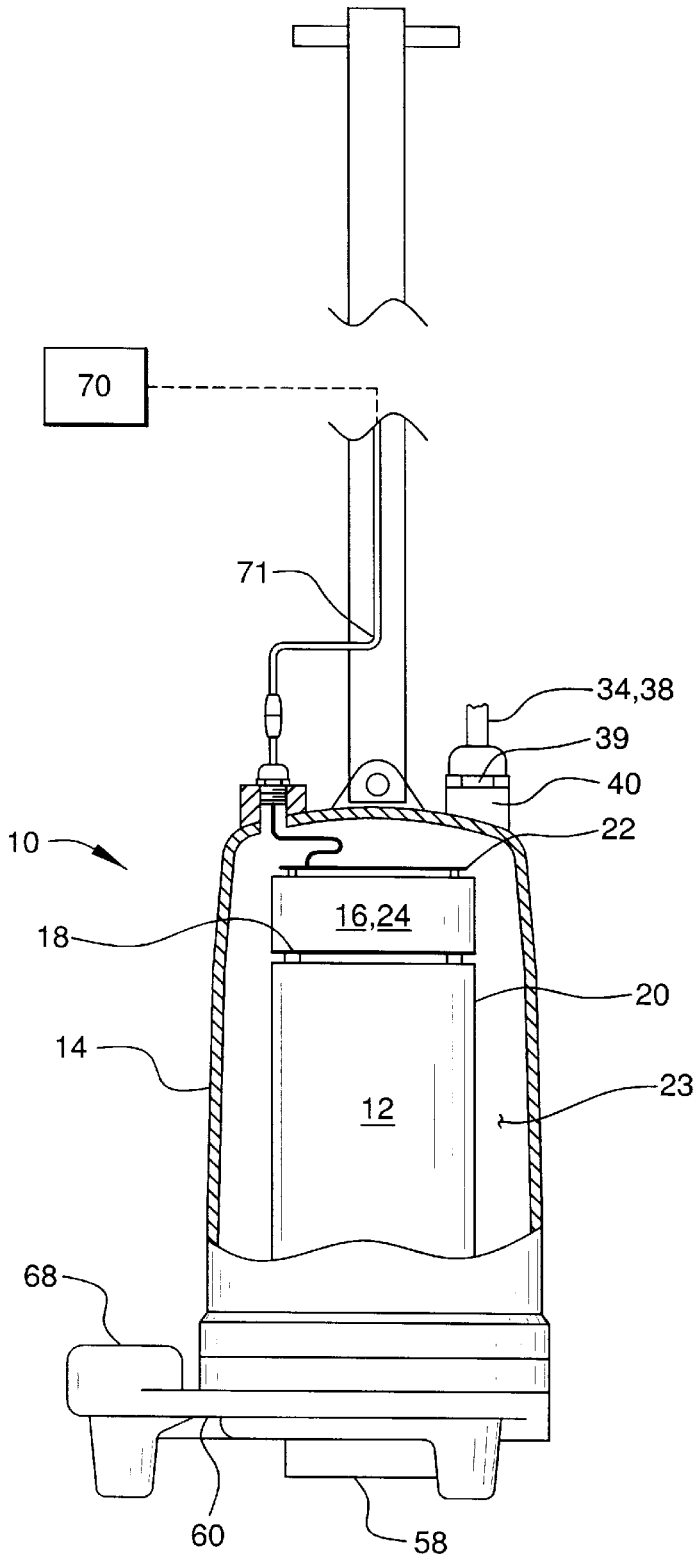
FIG. 1 is a somewhat schematic view of a submersible pump unit.
Figure 2:
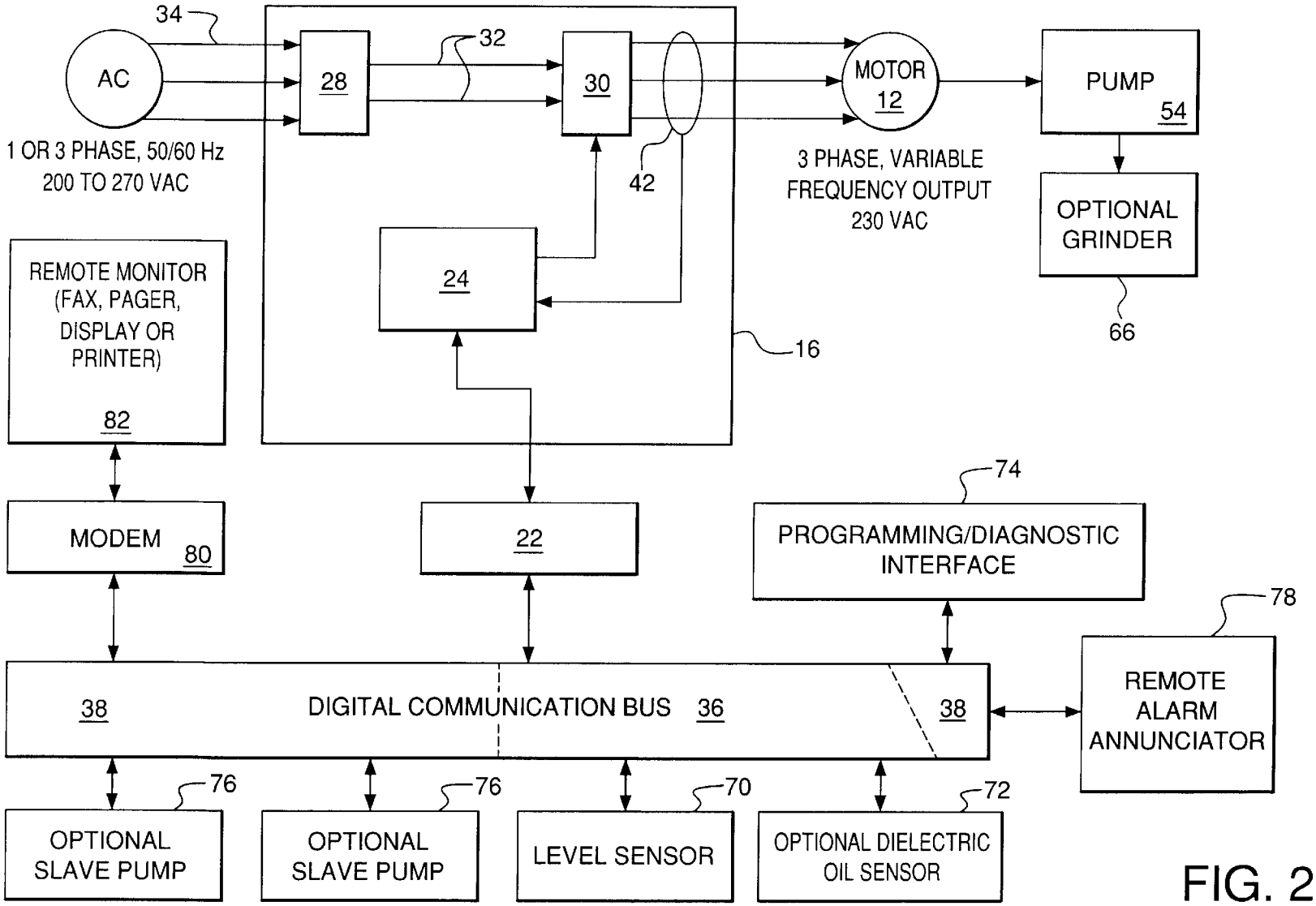
FIG. 2 is a block diagram of a control system of the pump unit of FIG. 1.
Figure 3:
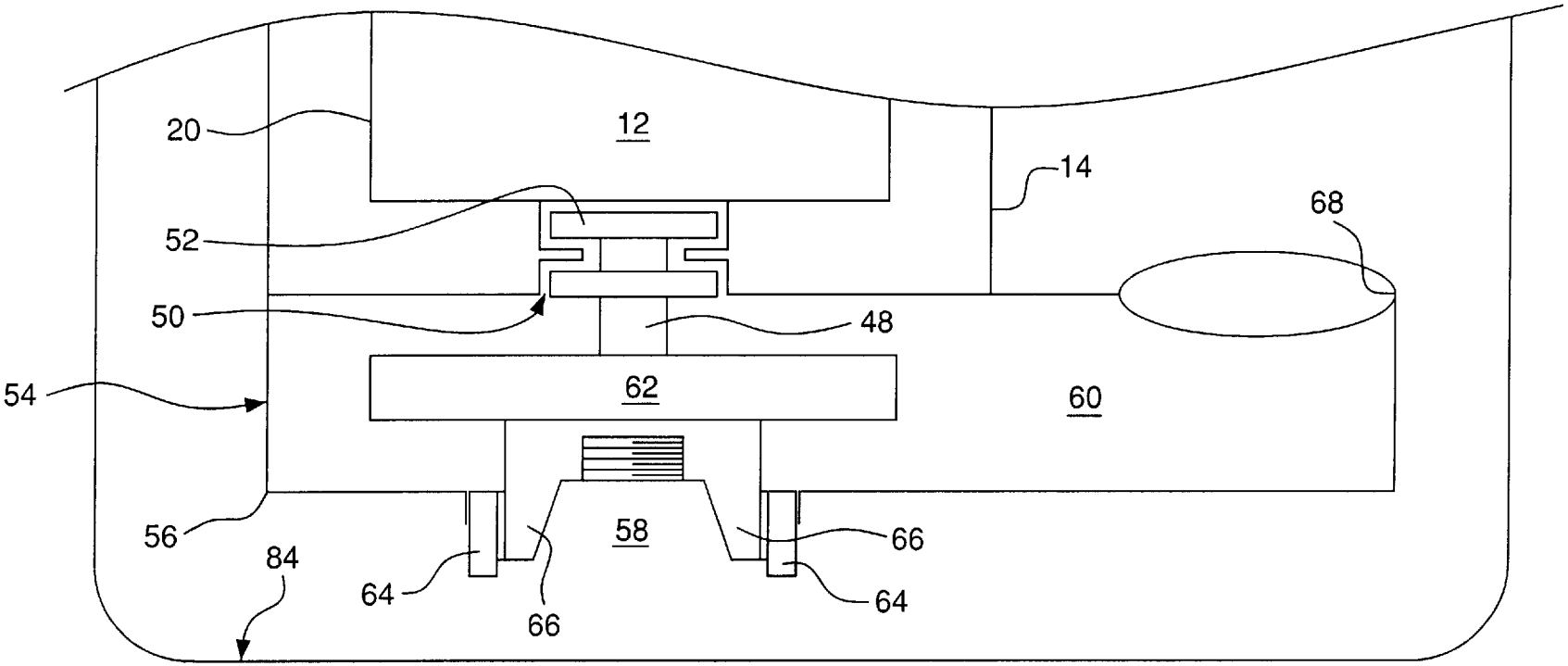
FIG. 3 is a side elevation view, partly cut away, of part of the pump unit of FIG. 1.

Referring to the drawings, wherein like reference numerals indicate corresponding elements throughout the several views, FIGS. 1 to 3 illustrate the present invention as it is incorporated in a submersible pump unit indicated generally by the reference numeral 10. The pump unit 10 comprises a 3-phase AC motor 12, mounted within a motor housing 14. A power module 16 is mounted immediately adjacent the motor 12. The power module is mounted on a heat sink and mounting plate 18, which is secured to the casing 20 of the motor 12. A thermal-conduction gel may be used to improve heat transfer from the electrical and electronic components of the power module 16 and the control board 22 to the heat sink 18. A control board 22, in the form of a printed circuit board (PCB) carrying a micro-controller and associated circuitry (not shown), is mounted immediately adjacent the power module 16. Within the associated circuitry may be included a memory medium of a type known in the art wherein an operating program may be stored. A bank of smoothing capacitors may also be mounted on the PCB 22.

The watertight housing 14 can isolate all of the electrical components 12, 16, 22 of the pump unit 10 from the liquid in which the pump unit is submerged. The housing 14 may be filled with dielectric oil 23, which assists in transferring the heat generated by the motor 12 and by the power module 16 to the external wall, where it can be dissipated into the external liquid. The heat sink 18 is then arranged to be in good thermal communication with the oil 23.

Referring to FIG. 2, the power module 16 may be a commercially-available sensorless flux vector controller. Such a controller 16 typically comprises a rectifier 28 and a variable-frequency power inverter 30, connected by a DC link 32. The inverter 30 is controlled by a microprocessor 24, which monitors the operation of the motor 12 by means of sensors 42 on the AC output from the inverter. The power module 16 is supplied with power through a single-phase or 3-phase, 220 volt, AC line 34 from the exterior of the housing 14. Preferably, the rectifier 28 is so constructed that it can rectify either a single-phase or a 3-phase input, so that the same pump unit 10 can be operated using whichever power supply is available. The DC voltage in the DC link 32 may be smoothed by the capacitors. The voltage of the public utility AC mains is not always exactly uniform, for example, a nominal 230 V supply may vary between 200 V and at least 250 V. Such wide variations in the supply voltage to the motor can reduce the efficiency of the pump, by making it difficult to match the speed and power consumption of the motor to the work to be done, and can also damage the motor. The inverter 30 is therefore arranged to supply output power of a regulated, constant voltage.

The control board 22 and the microprocessor 24 together constitute a controller for the pump unit 10, and it will be understood that some specific functions may be assigned to either the control board 22 or the microprocessor 24, depending on the specific construction and programming of each of those components in a particular pump unit 10. Part of the controller typically includes a memory device (not shown) storing a control program for automated pump operation. The memory may be part of the microprocessor 24 or it may comprise associated circuitry or devices on the control board. The control program comprises coded machine-readable instructions for operating the pump according to the process shown in FIGS. 5A and 5B and described below.

The control board 22 is in communication with a serial digital communication bus 36 comprising signal lines 38 that pass through a sealed port 40 in the housing 14 and are led away to a connection point remote from the pump unit 10. Instead of continuous signal lines 38 passing through the port 40, a watertight socket connection 39 may be provided at the housing 14, by which a separate external signal lead with a corresponding watertight plug can be inserted.

Referring to FIG. 3, the motor 12 has an output shaft 48, which passes out of the motor housing 14 through a seal 50. A second seal is preferably provided at the lower bearing 52 of the motor 12, where the output shaft 48 passes out of the casing 20 of the motor.

A centrifugal pump, indicated generally by the reference numeral 54, comprises a volute 56 fastened to the motor housing 14, and having an axial intake 58 and a tangential outlet 60. The pump 54 has an impeller 62 mounted co-axially on the output shaft 48.

Especially when the pump unit is intended for pumping aqueous media and the motor housing 14 is filled with an oil having a density less than that of water, the unit 10 is preferably designed to be used with the motor 12 vertically above the impeller 62. The inlet 58 of the pump is co-axial with the output shaft 48, on the opposite side of the impeller 62, and may be equipped with a fixed grinding element 64 that co-operates with a rotary grinding element 66, mounted on the end of the output shaft 48, to grind up solid objects entrained in the liquid being drawn into the pump 54.

If the pump unit 10 is intended for use only to pump liquids that do not contain entrained objects, or if any entrained objects are small enough to pass through the pump 54, or are not too solid to be broken up by the impeller 62, the grinding elements 64, 66 may be omitted. The tangential outlet 60 of the centrifugal pump 54 is provided with a standard connector 68 for a pipe (not shown).

In addition to controlling the motor 12, the controller 22, 24 also receives and emits information along the digital communication bus 36. For example, the control board 22 may receive inputs from a level sensor 70 for monitoring the level of the liquid being pumped, or from a dielectric oil sensor 72. The dielectric oil sensor 72 detects failure of, or leakage at, the seal 50 by capacitatively sensing the change in the dielectric constant of the oil 23 in the housing 14 if the oil 23 becomes mixed with water. The signal lines 38 also allow for input from, and output to, external devices. As shown in FIG. 2, the signal lines 38 may connect the control board 22 to a programming/diagnostic interface 74, and may enable the control board to control remote slave pumps 76, an alarm annunciator 78, and a modem 80 by which status information can be sent to or received from a remote monitor 82, which may be, for example, a fax, pager, display, a printer, or another computer.

As shown in FIG. 1, the level sensor 70 may be remote from the housing 14 of the pump unit, for example, it may be at or above the maximum level of liquid in which the pump unit is to be immersed. It is then preferably connected to the control board 22 by a signal line 71 wholly separate from the signal lines 38.

The operation of the pump unit 10 is as follows.

The pump unit 10 is installed in a sump or receiving tank 84 for liquid, and is provided with a power supply through the AC line 34 and is connected to any necessary external data sources through the signal lines 38. Preferably, information variable in dependence on the construction of the pump unit 10, for example, the characteristics of the particular motor and impeller used, is pre-programmed into the microprocessor 24 and/or the control board 22. Information concerning the individual installation, such as the height of lift required (and thus the head pressure experienced) at the outlet 60 of the pump 54, may be programmed into the microprocessor 24 on installation at the site, or may in some cases be determined dynamically by the microprocessor from sensor inputs once the pump unit is in use.

The pump unit 10 is preferably installed with the intake 58 of the pump 54 facing downwards and located near to the bottom of the tank 84. The correct positioning of the intake 58 in order to entrain any solids that may have settled out on the bottom of the tank 84 into the liquid being pumped, while not causing undue obstruction of the liquid flow into the pump intake, is well understood in the art and, in the interests of conciseness, will not be further discussed here.

In operation, the control board 22 determines the desired motor speed having regard to both the configuration of the pump unit and installation and the instantaneous state of the fluid within the system. By means of the microprocessor 24, the control board 22 controls the speed of the motor 12. By obtaining from the microprocessor 24 the power being drawn by the pump 54 and the speed of the pump, and from the known head pressure, the control board 22 verifies that the desired flow of liquid is being delivered.

The microprocessor 24 directly monitors the actual speed of the motor 12 by analysis of the data from the sensors 42, and compares the monitored speed with that calculated from the output frequency of the power inverter 30. Different motors, even from the same production, may have slightly different frequency/speed relationships, so that correcting the frequency set by reference to the actual speed of the particular motor can significantly increase the accuracy of control of the pump unit 10. In addition, the ratio of speed of a motor to power supply frequency changes as the motor ages, so that an abnormally low speed can be recognized as an indication of a motor in poor condition, and the control board 22 can generate an appropriate warning signal.

If the hydraulic conditions in a particular application are known and sufficiently constant, the microprocessor 24 may be programmed to maintain a fixed, preset motor speed.

Figure 4A:
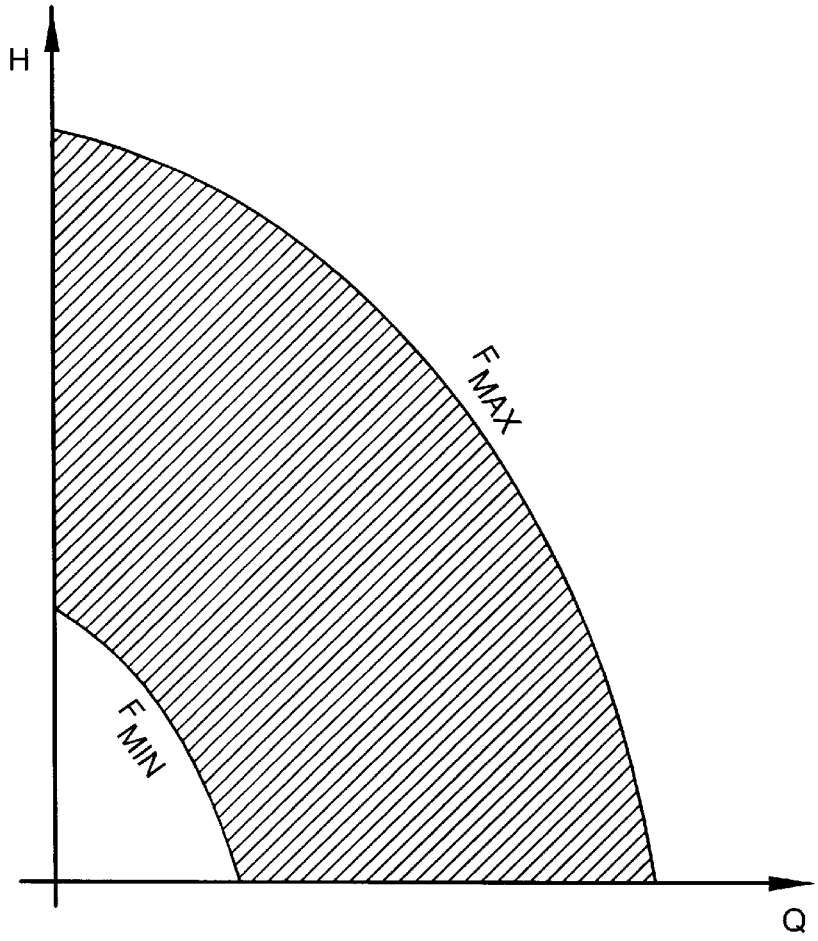
FIG. 4A is a graph of output head pressure against flow rate.
Figure 4B:
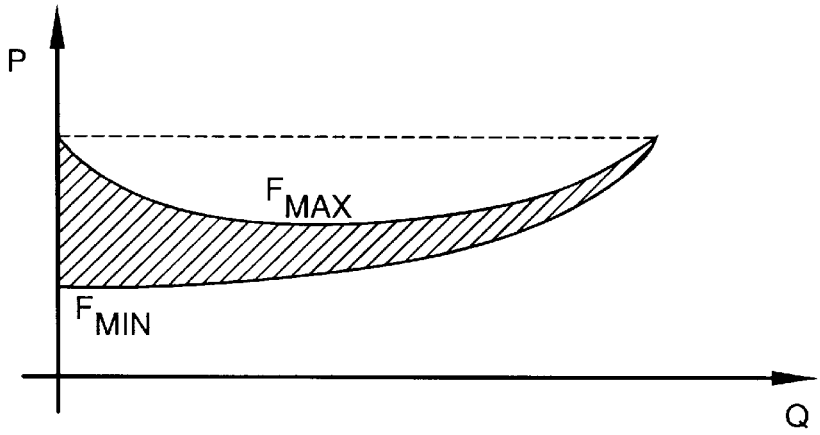
FIG. 4B is a graph of power consumption against flow rate.

Referring now to FIG. 4A, the output head H is plotted against the flow rate Q for a typical pump according to the above description. For any given pump speed or supply frequency F, there is an inverse relationship between the lift head H and the flow rate Q. There are a minimum speed $F_{MIN}$ and a maximum speed $F_{MAX}$ at which the pump can effectively be run and the curves of F against Q for those speeds effectively define the range of combinations of F and Q at which the pump can effectively be run.

Where the pump unit 10 is being used to empty the tank 84, the motor may be started when the level sensor 70 indicates that the tank is full, and may be stopped either when the level sensor indicates that the tank is empty, or when a sudden increase in the speed of the motor 12 indicates that the pump 54 is drawing in air rather than water.

Where the pump unit 10 is being used to empty the tank 84, the effective head H will usually increase as the liquid level in the tank falls, and that increase may be significant from an operational point of view. If the pump 54 was run at constant speed, the flow rate and power consumption would tend to decrease as the head increased. It is therefore desirable to monitor the instantaneous state of the system and to adjust the pump speed to maintain a desired flow rate. As shown in FIG. 4B, which is a graph of power consumption P against the flow rate Q, the power consumption P of the pump at any flow rate Q varies between a minimum and a maximum value, represented by the curves $F_{MIN}$ and $F_{MAX}$, respectively, according to the head H.

It is therefore possible, by simultaneously referencing the pump speed set by the control board 22 and the power consumption, derived via the sensors 42 from electrical measurements of the AC supply to the motor 12, to track the process of emptying the tank. In addition, because the control board 22 can discriminate between a high head, low flow condition and a low head, high flow condition, and because the controller controls the motor speed directly, a higher maximum speed can be allowed than with a conventional pump unit when pumping against a high head, without the risk that an unacceptably high speed might be permitted when pumping against a low head.

The controller 22, 24 will usually be programmed with minimum and maximum limits for the head pressure and flow rate, and maximum values for the operating temperature and flow rate. Depending on the design of the pump 54 and motor 12, the microprocessor 24 may also be programmed to prevent operation in any danger zone where overheating of the motor is likely, for example, when pumping at high speeds against little or no head. The motor 12 may also be provided with a temperature sensor, and the control board 22 may shut the motor down if it begins to overheat.

Instead of, or in addition to, the automatic control of the pump by the control board 22, the pump unit may be controlled either manually or by an external automatic controller through the signal lines 38. Such external control may be desirable if the pump unit 10 forms part of a larger system, and co-ordination with other parts of the system is desirable, or if a situation arises with which the controller is not programmed to cope, or if a malfunction of the systems within the pump unit 10 is diagnosed. The external control point may be either on-site or at a remote location.

The control board 22 may itself control other pumps 76 with which its operation is to be coordinated. For example, several pumps may be daisy-chained to transport liquid up a considerable head or over a considerable distance, and it may be preferable to co-ordinate their operation actively, rather than having each respond autonomously to the arrival of liquid from the one before it. Alternatively, if several pumps are acting in parallel, it may be desirable to co-ordinate their activity, either so that the number of pumps active increases and decreases in proportion to the volume of liquid to be pumped, or so that they alternate their activity to share the wear and tear and/or to avoid overloading the next stage downstream.

The control board 22 may also be arranged to vary the time of startup of the motor 12, either in co-ordination with other pump units or randomly, in order to avoid excessive peak loads on the power supply or on the next stage downstream, in conditions, for example, after a power outage, when it can be expected that numerous electric appliances, possibly including several pump units 10, would otherwise start up simultaneously.

The pump unit 10 may also be equipped with various sensors, and the control board 22 may be arranged to monitor various fault states. The following are examples. A conventional overload circuit breaker (not shown) may be provided in the power supply, either within the unit 10 or externally; if the overload circuit breaker is within the pump unit, the control board 22 can monitor its activity, and discriminate that from other causes of loss of power. Dry running of the pump can be identified by a power consumption too low for the pump speed. A power supply voltage too low or too high for the inverter 30 or the motor 12 can be measured directly. Failure of sensors may be detected if they give incredible readings. If liquid level sensors are used, a failure may be inferred if the liquid level in the tank 84 apparently fails to fall when the pump is active, or to rise when the pump is inactive.

Figure 5A:
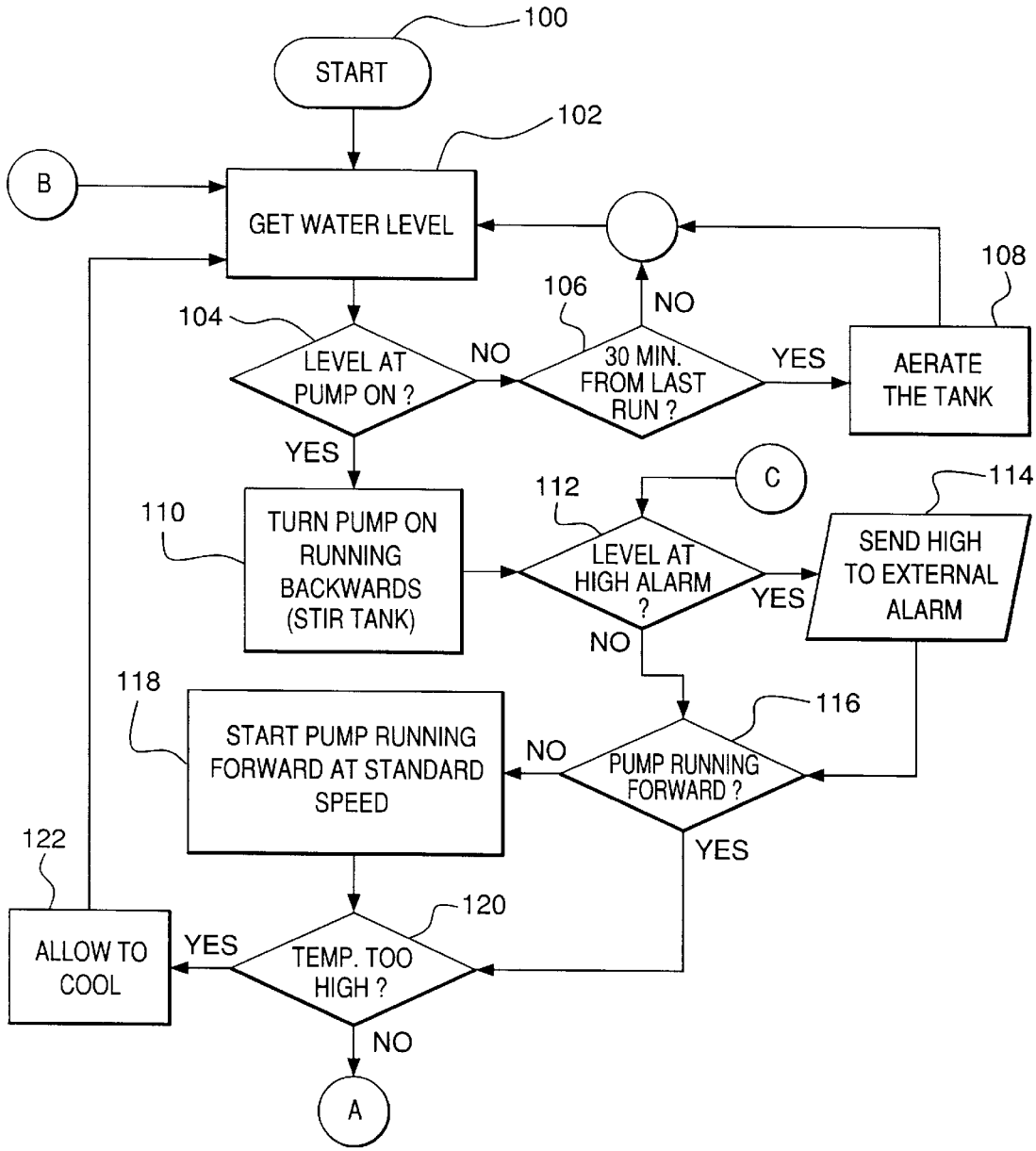
FIGS. 5A and 5B are a flow-chart.
Figure 5B:
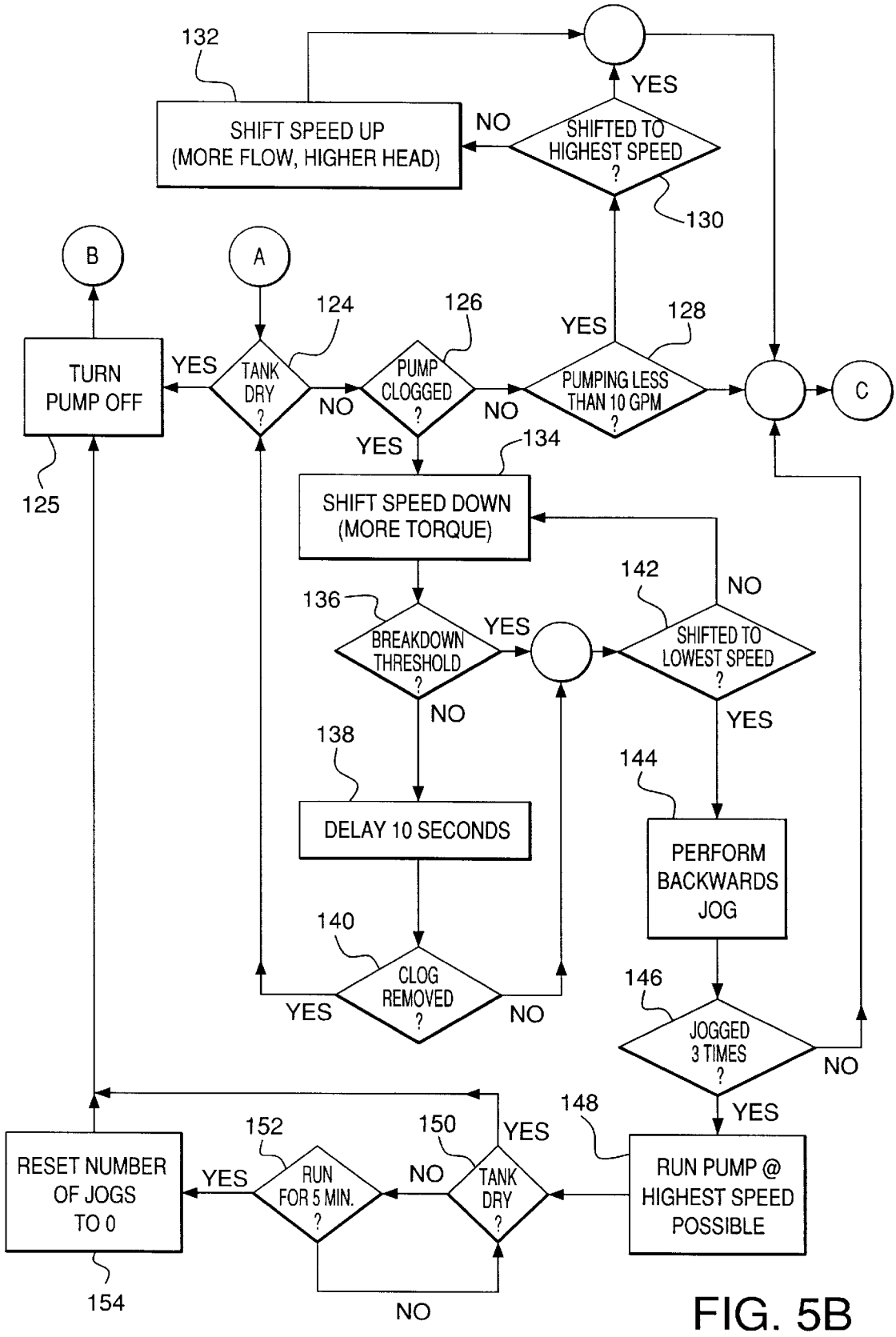

Referring now to FIGS. 5A and 5B, one method of operating the pump is as follows.

Starting at step 100, the controller 22, 24 obtains the liquid level in the tank 84 from the level sensor 70 at step 102. At step 104, the controller 22, 24 tests whether the water level is sufficiently high that the pump 54 should be started. If the water level is not sufficiently high, and liquid containing solids remains in the tank 84 for too long, the controller 22, 24 may run the motor 12 backwards to aerate or agitate the tank contents and re-suspend the solids. The rotation of the pump impeller 62 and the rotary grinding element 66 naturally causes a vortex in the liquid below the inlet of the pump. When the pump stops, solids in the liquid tend to settle out in the middle of the vortex, directly below the pump intake 58. Running the pump in reverse generates the vortex and re-suspends the solids. The pump is run at the shut-off speed, at which it cannot pump any appreciable quantity of liquid against the head in the outlet pipe. The controller checks at step 106 whether the pump has been run recently. In this embodiment, it checks whether it is more than 30 minutes since the pump has been run. If so, at step 108 the pump is run backwards. The reverse running may be terminated after a preset time. After agitation, or if agitation is not necessary, the process returns to step 102 and obtains an updated liquid level.

If at step 104 the level is high enough that the pump 54 should be started, the motor 12 is run backwards for a short period at step 110 to re-suspend the solids immediately before pumping starts. That assists in ensuring that, when forward pumping starts, the solids will be removed along with the liquid.

The controller then tests, at step 112, whether the liquid level is sufficiently high to require an alarm. That will not normally be the case at this stage, when the liquid level has only just passed the normal threshold to start pumping. However, at a later stage in the method (step 122 below) the controller may loop back to steps 102 and 104 with the tank over-full. If an alarm is required, it is sent to the alarm annunciator at step 114. The controller 22, 24 then proceeds to step 116, where it tests whether the pump 10 is running forwards or backwards. If the pump is running backwards, as it is when proceeding from step 110, then at step 118 it is switched to run forwards at standard speed. The controller then checks at step 120 whether the pump is overheating and, if it is, stops the pump at step 122 to allow it to cool. The pump may be stopped for a predetermined period, or until its temperature has fallen to a predetermined value. The controller then returns to step 102 to start pumping again. In this case, when the controller reaches step 112, the delay in pumping caused by the overheating motor may have allowed the liquid level to rise high enough to require an alarm at step 114.

If the pump is not overheating, the controller 22, 24 proceeds from step 120 to step 124, where it tests whether the tank 84 is empty, or at least sufficiently empty that the pump 54 cannot usefully continue pumping. This may be determined by a level sensor, or by determining from a sudden drop in motor torque that the pump has started to pump air instead of liquid. If the tank is empty, the controller turns the pump off at step 125, and returns to steps 102 to 108 to wait until the tank is full enough for more pumping.

If at step 124 the tank is not empty, the controller 22, 24 tests at step 126 whether the pump 54 is clogged. Where the liquid contains solids, such blockages may occur especially on startup. For example, the intake 58 or the outlet 60 of the pump 54 may be obstructed so that no liquid can flow, the pump impeller 62 may be clogged so that it rotates without effectively propelling the liquid, or the impeller or grinder may actually be jammed. The controller 22, 24 may detect blockages, for example, by detecting that the motor 12 is developing an unacceptably high torque.

If the pump is not clogged, the controller checks the rate of pumping at step 128. If the rate of pumping is less than a certain value, for example, 10 GPM (38 liters/min), the controller at step 130 tests whether the pump is running at maximum speed and, if it is not, increments the speed at step 132. The controller 22, 24 then returns to step 112, and tests again whether the liquid has risen to the alarm level. Under normal conditions, the controller will then loop repeatedly through steps 112, 116, 120, 124, 126, and 128. The speed will be increased if necessary at steps 130 and 132 until the pump either is pumping at least the threshold amount of liquid set for step 128, or is running at maximum speed. The looping will continue, unless the pump overheats as detected at step 120, or until the tank is empty as detected at step 124.

If the microprocessor 24 or the control board 22 detects at step 126 that the pump 54 is blocked, the controller may progressively reduce the speed of the motor, allowing the torque to increase to the safe limit at each speed, in an attempt to free the blockage without exceeding the permissible maximum torque at any speed. At step 134, the pump is shifted to a lower speed and the torque is allowed to increase. It is a significant advantage, when the pump 54 may be blocked by solids at startup, that the 3-phase AC motor 12 can develop high torque at low speeds. The controller then tests at step 136 whether the torque has reached a breakdown threshold for the motor 12. If not, the controller allows the motor to continue to run at step 138 for a short period, for example, 10 seconds, and then tests at step 140 whether the clog has been removed. If the clog has been removed, the controller returns to step 124, and tests whether the tank is empty yet. If the breakdown threshold has been reached at step 136, or if the clog has not been removed at step 140, then the controller tests at step 142 whether the pump is running at its lowest speed. If it is not, the controller returns to step 134, and reduces the speed further.

If the controller determines at step 142 that the pump is already at its lowest speed, then the controller may attempt to free the pump automatically, by a sequence of short bursts of forward and/or reverse motor power. At step 144 the pump is jogged backwards. At step 146, the controller checks whether the pump has been jogged three times. If not, it returns to step 112. Assuming that the clog is not removed, the pump will then be run forwards, first at normal speed in step 118 and then more and more slowly in step 134, before returning to step 144 for another backwards jog. If that approach fails, after the third backwards jog the controller may run the motor 12 for a limited period at high speed. Thus, at step 148, the controller thus starts the pump running at maximum speed. The pump continues to run while the controller loops repeatedly through steps 150 and 152. At step 150, the controller tests whether the tank is empty. If the tank becomes empty, the controller turns the pump off at step 106, and returns to step 102. At step 152, the controller tests whether the pump has been running for 5 minutes. If it has, the controller at step 154 resets the count of jogs used for step 146 to zero, switches the pump off, and returns to step 102. After, or in addition to, those expedients, the control board 22 may raise an alarm.

When a failure is detected, the control board 22 may take precautionary measures, which may include switching to an emergency program, or if necessary shutting down the pump unit 10, and may give out an alarm and/or report via the signal lines 38. Failures of the signal lines 38 can be detected by the control board 22. If the signal lines 38 fail, the control board 22 switches to a fail-safe mode, and the external controller may generate an alarm signal. If the pump unit 10 is operating in response to liquid level sensors in the pump unit itself, it can continue substantially normal operation when the signal lines 38 fail, but without the facility to communicate with external diagnostic or alarm systems. If the pump unit 10 is relying on liquid level signals received along the signal lines 38, then the fail-safe mode may consist of running the pump until a sudden drop in the motor torque indicates that the tank 84 has been emptied, and then stopping the pump and waiting for a predetermined period before starting the pump again.

The microprocessor 24 may also be programmed to control the acceleration and deceleration of the motor 12, in order to reduce the starting current and/or to reduce water hammer. The starting current may be reduced by 50% compared with conventional switching of a similar motor. When liquid containing solids is to be pumped, an algorithm that starts the motor with very high torque is preferred, to achieve comparatively reliable starting even if solids are present in the grinder 64, 66 or the pump 54.

The control board 22 may also be equipped and programmed to monitor and record operational statistics for monitoring and maintenance purposes. The statistics recorded preferably include: minimum, average, and maximum values of the power consumption and motor temperature; the initial, average, and present values of the dielectric constant of the oil in the housing 14; and the average and maximum rates of flow of liquid into the tank 84. The influent flow rate figures may be used as a basis for charges for handling or processing the liquid. Other data monitored may include: the number of operating cycles and the runtime over a current period and in total; the minimum, average, and maximum AC supply voltage; the minimum, average, and maximum operating current of the motor 12; the minimum, average, and maximum output head; the average and maximum discharge flow rate, and the total volume pumped; and the amount of vibration of the motor.

The pump unit may be equipped so that a hand-held, portable, battery-operated tester can be plugged into a data port on the digital signal lines 38 in order to test its correct operation. The tester can be arranged to test at least the integrity of the wiring, the supply voltage (both with the pump on and with it off), the motor current, the liquid discharge rate, and the operation of the modem and the alarm annunciator.

Although the invention has been described and illustrated with reference to an exemplary embodiment thereof, it will be understood by those skilled in the art that various changes, omissions, and additions may be made thereto, without departing from the spirit and scope of the invention as recited in the attached claims. For example, the power module 16, instead of being mounted on top of the motor 12, may be mounted adjacent, and thermally bonded to, the tangential outlet 60 of the pump 54, so that the liquid being pumped carries away with it the excess heat from the power module. That is especially preferred when the pump unit 10 is intended to be used to empty the tank 84 to a level at which the housing 14 is no longer mainly submerged.

I claim:

1. A method of operating a variable-speed pump driven by a motor capable of developing high torque at low speeds, comprising the steps of:

running the pump at a first selected speed;

determining whether the pump is clogged by assessing the torque being generated by the motor;

when the torque being developed by the motor exceeds a maximum for the selected speed, reducing the selected speed of the pump and thereby increasing the maximum acceptable torque for the motor;

determining whether the pump is still clogged by assessing the torque being generated by the motor;

when the torque exceeds said increased maximum acceptable torque for the newly selected speed, repeating the steps of reducing the speed and assessing the torque; and at any point when it is determined that the pump is no longer clogged, resuming pumping at said first selected speed.

2. A method according to claim 1, further comprising, when the selected speed is reduced to a minimum speed and it is determined that the pump is still clogged, the steps of:

running the pump backwards; and repeating the steps recited in claim 1.

3. A method according to claim 2, further comprising the steps of running the pump backwards a second time, forwards a third time, and backwards a third time.

4. A method according to claim 1 for emptying a tank that may contain both liquid and solids, further comprising the steps of:

determining whether the tank is sufficiently full for emptying to be appropriate;

running the pump backwards to agitate the tank when emptying the tank is appropriate;

after agitating the tank, running the pump forwards to remove contents from the tank;

determining whether a predetermined period has elapsed since the pump was last run when emptying the tank is not appropriate; and running the pump backwards to agitate the tank when the predetermined period has elapsed.

5. A method according to claim 4, wherein the tank is determined to be sufficiently full if the level of liquid in the tank is higher than a certain level.

6. A method according to claim 4, wherein the step of running the pump forwards ceases when it is determined that the tank is empty.

7. A method according to claim 6, wherein it is determined that the tank is empty when the torque consumed by the pump decreases suddenly.

8. A method according to claim 4, wherein the step of running the pump backwards if emptying is not appropriate takes place at a minimum operating speed of the pump.

9. A method according to claim 4 of operating a pump that comprises an electric motor, further comprising the steps of: monitoring the temperature of the motor; and stopping the pump if its temperature is too high.

10. A method according to claim 9, further comprising the step of restarting the motor after a predetermined time.

11. A method according to claim 9, further comprising the step of restarting the motor when its temperature falls to a predetermined value.

12. A method according to claim 4, further comprising the step of emitting an alarm if the level of liquid in the tank exceeds an alarm level higher than the level at which emptying of the tank is appropriate.

13. A method according to claim 4, further comprising the steps of increasing the rate of pumping if the rate of pumping is less than a preset rate, the speed of the pump is less than the maximum speed, and the pump is pumping normally.

14. A method of operating a variable-speed pump driven by a motor capable of developing high torque at low speeds, comprising the steps of:

a. running the pump at a first selected speed;

b. determining whether the pump is clogged by assessing the torque being generated by the motor;

c. when the torque being developed by the motor exceeds a maximum for the selected speed, reducing the selected speed of the pump and thereby increasing the maximum acceptable torque for the motor;

d. determining whether the pump is still clogged by assessing the torque being generated by the motor;

e. when the torque exceeds said increased maximum acceptable torque for the newly selected speed, repeating the steps of reducing the speed and assessing the torque;

f. at any point when it is determined that the pump is no longer clogged, resuming pumping at said first selected speed;

g. when the selected speed is reduced to a minimum speed and it is determined that the pump is still clogged, the steps of:

g1. running the pump backwards; and g2. repeating steps a. through f.; and h. running the pump forwards at maximum speed for a predetermined period of time.

15. A method according to claim 14 for emptying a tank that may contain both liquid and solids, further comprising the steps of:

determining whether the tank is sufficiently full for emptying to be appropriate;

running the pump backwards to agitate and aerate the tank when emptying the tank is appropriate;

after agitating and aerating the tank, running the pump forwards to remove contents from the tank;

determining whether a predetermined period has elapsed since the pump was last run when emptying the tank is not appropriate; and running the pump backwards to agitate the tank when the predetermined period has elapsed.

16. A method according to claim 15, wherein the tank is determined to be sufficiently full if the level of liquid in the tank is higher than a certain level.

17. A method according to claim 15, wherein the step of running the pump forwards ceases when it is determined that the tank is empty.

18. A method according to claim 17, wherein it is determined that the tank is empty when the torque consumed by the pump decreases suddenly.

19. A method according to claim 15, wherein the step of running the pump backwards if emptying is not appropriate takes place at a minimum operating speed of the pump.

20. A method according to claim 15 of operating a pump that comprises an electric motor, further comprising the steps of: monitoring the temperature of the motor; and stopping the pump if its temperature is too high.

21. A method according to claim 20, further comprising the step of restarting the motor after a predetermined time.

22. A method according to claim 20, further comprising the step of restarting the motor when its temperature falls to a predetermined value.

23. A method according to claim 15, further comprising the step of emitting an alarm if the level of liquid in the tank exceeds an alarm level higher than the level at which emptying of the tank is appropriate.

24. A method according to claim 15, further comprising the steps of increasing the rate of pumping if the rate of pumping is less than a preset rate, the speed of the pump is less than the maximum speed, and the pump is pumping normally.

25. A variable speed pump controller for a pump submersed in a vessel, said controller comprising a computer program for controlling the pump, said program comprising machine readable coded instructions for performing the following steps:

running the pump at a first selected speed;

determining whether the pump is clogged by assessing the torque being generated by the motor;

when the torque being developed by the motor exceeds a maximum for the selected speed, reducing the selected speed of the pump and thereby increasing the maximum acceptable torque for the motor;

determining whether the pump is clogged by assessing the torque;

if the torque exceeds a maximum for the newly selected speed, repeating the steps of reducing the speed and permitting the torque to rise; and if at any point it is determined that the pump is no longer clogged, resuming said first selected speed.

26. A pump controller according to claim 25, further comprising computer program instructions, when the selected speed is reduced to a minimum speed and it is determined that the pump is still clogged, for performing the steps of:

running the pump backwards; and repeating the steps recited in claim 26.

27. A pump controller according to claim 26, further comprising computer program instructions for performing the step of running the pump forwards at maximum speed for a predetermined period of time.

28. A variable speed pump controller for a pump submersed in a vessel, said controller comprising a computer program for controlling the pump, said program comprising machine readable coded instructions for performing the following steps:

running the pump at a first selected speed;

determining whether the pump is clogged by assessing the torque being generated by the motor;

when the torque being developed by the motor exceeds a maximum for the selected speed, reducing the selected speed of the pump and thereby increasing the maximum acceptable torque for the motor;

determining whether the pump is clogged by assessing the torque;

if the torque exceeds a maximum for the newly selected speed, repeating the steps of reducing the speed and permitting the torque to rise;

if at any point it is determined that the pump is no longer clogged, resuming said first selected speed; and if the selected speed is reduced to a minimum speed and it is determined that the pump is still clogged:

running the pump backwards, and repeating the first through sixth steps recited above; and running the pump backwards a second time, forwards a third time, and backwards a third time.

29. A computer program for controlling a variable speed submersible pump, said program comprising coded instructions for performing the following control steps:

running the pump at a first selected speed;

determining whether the pump is clogged by assessing the torque being generated by the motor;

when the torque being developed by the motor exceeds a maximum for the selected speed, reducing the selected speed of the pump and thereby increasing the maximum acceptable torque for the motor;

determining whether the pump is still clogged by assessing the torque unless and until it exceeds a maximum for the newly selected speed;

repeating the steps of reducing the speed and permitting the torque to rise; and if at any point it is determined that the pump is no longer clogged, resuming said first selected speed.

30. A computer program according to claim 29, further comprising instructions for performing, when the selected speed is reduced to a minimum speed and it is determined that the pump is still clogged, the steps of:

running the pump backwards; and repeating the steps recited in claim 30.

31. A computer program according to claim 30, further comprising instructions for performing the steps of:

running the pump backwards a second time, forwards a third time, and backwards a third time.

32. A computer program according to claim 29 for emptying a tank that may contain both liquid and solids, comprising coded instruction for performing the steps of:

determining whether the tank is sufficiently full for emptying to be appropriate;

running the pump backwards to agitate the tank when emptying the tank is appropriate;

after agitating the tank, running the pump forwards to remove contents from the tank;

determining whether a predetermined period has elapsed since the pump was last run when emptying the tank is not appropriate; and running the pump backwards to agitate the tank when the predetermined period has elapsed.

33. A computer program according to claim 32, wherein the tank is determined to be sufficiently full if the level of liquid in the tank is higher than a certain level.

34. A computer program according to claim 32, wherein the program step of running the pump forwards ceases when it is determined that the tank is empty.

35. A computer program according to claim 34, further comprising a program step wherein it is determined that the tank is empty when the torque consumed by the pump decreases suddenly.

36. A computer program according to claim 32, further comprising a program step wherein the step of running the pump backwards if emptying is not appropriate takes place at a minimum operating speed of the pump.

37. A computer program according to claim 32 for operating a pump that comprises an electric motor, further comprising the program steps of:

monitoring the temperature of the motor; and stopping the pump if its temperature is too high.

38. A computer program according to claim 37, further comprising the program step of restarting the motor after a predetermined time.

39. A computer program according to claim 37, further comprising the program step of restarting the motor when its temperature falls to a predetermined value.

40. A computer program according to claim 32, further comprising the program step of emitting an alarm if the level of liquid in the tank exceeds an alarm level higher than the level at which emptying of the tank is appropriate.

41. A computer program according to claim 32, further comprising the program steps of increasing the rate of pumping if the rate of pumping is less than a preset rate, the speed of the pump is less than the maximum speed, and the pump is pumping normally.

42. A computer program for controlling a variable speed submersible pump, said program comprising coded instructions for performing the following control steps:

a. running the pump at a first selected speed;

b. determining whether the pump is clogged by assessing the torque being generated by the motor;

c. when the torque being developed by the motor exceeds a maximum for the selected speed, reducing the selected speed of the pump and thereby increasing the maximum acceptable torque for the motor;

d. determining whether the pump is still clogged by assessing the torque unless and until it exceeds a maximum for the newly selected speed;

e. repeating the steps of reducing the speed and permitting the torque to rise;

f. if at any point it is determined that the pump is no longer clogged, resuming said first selected speed;

g. when the selected speed is reduced to a minimum speed and it is determined that the pump is still clogged:

g1. running the pump backwards; and g2. repeating steps a. through f.; and h. running the pump forwards at maximum speed for a predetermined period of time.

43. A computer program according to claim 42 for emptying a tank that may contain both liquid and solids, comprising coded instruction for performing the steps of:

determining whether the tank is sufficiently full for emptying to be appropriate;

running the pump backwards to agitate and aerate the tank when emptying the tank is appropriate;

after agitating and aerating the tank, running the pump forwards to remove contents from the tank;

determining whether a predetermined period has elapsed since the pump was last run when emptying the tank is not appropriate; and running the pump backwards to agitate the tank when the predetermined period has elapsed.

44. A computer program according to claim 43, wherein the tank is determined to be sufficiently full if the level of liquid in the tank is higher than a certain level.

45. A computer program according to claim 43, wherein the program step of running the pump forwards ceases when it is determined that the tank is empty.

46. A computer program according to claim 45, further comprising a program step wherein it is determined that the tank is empty when the torque consumed by the pump decreases suddenly.

47. A computer program according to claim 43, further comprising a program step wherein the step of running the pump backwards if emptying is not appropriate takes place at a minimum operating speed of the pump.

48. A computer program according to claim 43 for operating a pump that comprises an electric motor, further comprising the program steps of:

monitoring the temperature of the motor; and stopping the pump if its temperature is too high.

49. A computer program according to claim 48, further comprising the program step of restarting the motor after a predetermined time.

50. A computer program according to claim 48, further comprising the program step of restarting the motor when its temperature falls to a predetermnined value.

51. A computer program according to claim 43, further comprising the program step of emitting an alarm if the level of liquid in the tank exceeds an alarm level higher than the level at which emptying of the tank is appropriate.

52. A computer program according to claim 43, further comprising the program steps of increasing the rate of pumping if the rate of pumping is less than a preset rate, the speed of the pump is less than the maximum speed, and the pump is pumping normally.

53. A method of operating a variable-speed pump driven by a motor capable of developing high torque at low speeds, comprising the steps of:

determining whether the tank is sufficiently full for emptying to be appropriate;

when emptying the tank is not appropriate, determining whether a predetermined period has elapsed since the pump was last run;

running the pump backwards to agitate the tank when the predetermined period has elapsed;

when emptying the tank is appropriate, running the pump backwards to agitate the tank;

after agitating the tank, running the pump forwards at a selected speed to remove contents from the tank;

determining whether the pump is clogged by assessing the torque being generated by the motor;

when the torque being developed by the motor exceeds a maximum for the selected speed, reducing the selected speed of the pump and thereby increasing the maximum acceptable torque for the motor;

assessing the torque;

when the torque exceeds said maximum acceptable torque for the newly selected speed, repeating the steps of reducing the speed and assessing the torque; and at any point when it is determined that the pump is no longer clogged, resuming pumping at said first selected speed.

54. A method of operating a variable-speed pump driven by a motor capable of developing high torque at low speeds, comprising the steps of:

running the pump at a first selected speed;

determining whether the pump is pumping fluid at a predetermined rate;

if not, determining whether the pump is operating at a maximum speed;

if not, incrementing the speed of the pump;

repeating the determining and incrementing steps until either the speed of the pump reaches said maximum speed or the rate of pumping reaches said predetermined rate;

determining whether the pump is clogged by assessing the torque being generated by the motor;

when the torque being developed by the motor exceeds a maximum for the selected speed, reducing the selected speed of the pump and thereby increasing the maximum acceptable torque for the motor;

repeating the steps of assessing the torque and reducing the speed; and at any point when it is determined that the pump is no longer clogged, resuming pumping at said first selected speed.

* * * * *